US007240436B1

(12) United States Patent
Miller et al.

(10) Patent No.: US 7,240,436 B1
(45) Date of Patent: Jul. 10, 2007

(54) DOOR FRAME ALIGNMENT DEVICE

(76) Inventors: Charles R. Miller, 687 Salt Springs Rd., Mineral Ridge, OH (US) 44440; Brad Shultz, 4265 NE. 139th La., Anthony, FL (US) 32617

( * ) Notice: Subject to any disclaimer, the term of this patent is extended or adjusted under 35 U.S.C. 154(b) by 0 days.

(21) Appl. No.: 11/335,775

(22) Filed: Jan. 20, 2006

(51) Int. Cl.
*G01B 3/30* (2006.01)

(52) U.S. Cl. ..... 33/194; 33/613

(58) Field of Classification Search ..... 33/194, 33/197, 613, 645
See application file for complete search history.

(56) References Cited

U.S. PATENT DOCUMENTS

| | | | | |
|---|---|---|---|---|
| 1,317,799 | A * | 10/1919 | Leibbrand | 33/197 |
| 2,733,518 | A * | 2/1956 | Pszegon | 33/197 |
| 3,745,664 | A * | 7/1973 | Altseimer | 33/197 |
| 4,715,590 | A | 12/1987 | Segarra | |
| 5,123,172 | A * | 6/1992 | Thrun | 33/194 |
| 5,913,546 | A | 6/1999 | Kuchenbrod et al. | |
| 6,442,853 | B1 | 9/2002 | Hale et al. | |
| 6,807,777 | B2 | 10/2004 | Wagner et al. | |
| 6,810,592 | B1 | 11/2004 | Oldfield, Jr. | |
| 6,954,989 | B1 * | 10/2005 | Morton | 33/194 |
| 2002/0121027 | A1 * | 9/2002 | Kruskamp | 33/645 |
| 2002/0133957 | A1 * | 9/2002 | Farese | 33/194 |
| 2002/0170189 | A1 * | 11/2002 | Cheatham | 33/194 |
| 2006/0272166 | A1 * | 12/2006 | Adkins et al. | 33/197 |

* cited by examiner

*Primary Examiner*—G. Bradley Bennett
(74) *Attorney, Agent, or Firm*—Harpman & Harpman

(57) ABSTRACT

An alignment and positioning guide tool for use in mounting metal door frames in metal wall stud construction. The device is a one-piece integral unit having a pair of spaced parallel engagement legs extending from an integral body member. The free ends of the legs extend outwardly for selective engagement with the door frame. The tool is positioned over the stud wall mounting base plate and slidably positioned therealong for engagement reference of a door jam during framing.

5 Claims, 3 Drawing Sheets

DOOR FRAME ALIGNMENT DEVICE

BACKGROUND OF THE INVENTION

1. Technical Field

This invention relates to construction tools, specifically framing guides and jigs used in the alignment of metal wall framing elements to one another during construction.

2. Description of Prior Art

Prior art is defined by the increased use of metal wall framing components utilizing metal wall studs, window and door frames. Metal framing has many advantages in commercial construction due to the effective cost savings and building code requirements and the use of non-flammable materials.

Prior art alignment tools of this type can be seen, for example, in U.S. Pat. Nos. 4,715,590, 5,913,546, 6,442,852, 6,810,592.

In U.S. Pat. No. 4,715,590 a positioning device for installing door frames is disclosed having an inverted L-shaped frame which is aligned to the vertical side element of the frame to be aligned and held in position.

U.S. Pat. No. 5,913,546 is directed to a stud alignment tool having a U-shaped main body member with an integral cross joining element therebetween. Grooves are formed on the oppositely disposed relation to one another so as to engage on the corresponding edge of a metal stud onto which it is positioned.

U.S. Pat. No. 6,442,852 discloses a door jam square that is used to square up a door frame during and prior to installation.

An adjustable door jam setting jig is claimed in U.S. Pat. No. 6,810,592 wherein a base member has longitudinally spaced parallel arms which telescopically receive corresponding extension members with a parallel support member that can be adjustably extended for registration against the inside surface of a door jam to be mounted.

U.S. Pat. No. 6,807,777 is on a door spacer block having a monolithic rectangular body member with multiple parallel circumferentially spaced engagement grooves therein. A number of identical extensions along multiple adjacent surfaces so as to provide for measured alignment indication when interengaged on a framing member in various orientations.

SUMMARY OF THE INVENTION

A door mounting alignment and positioning tool for metal door frames and metal stud wall framing. The door mounting tool provides for selective movable engagement on metal wall stud elements with extending door frame registration legs to properly position a metal door frame to and within a stud frame wall opening.

DETAILED DESCRIPTION OF THE INVENTION

Figure 1:
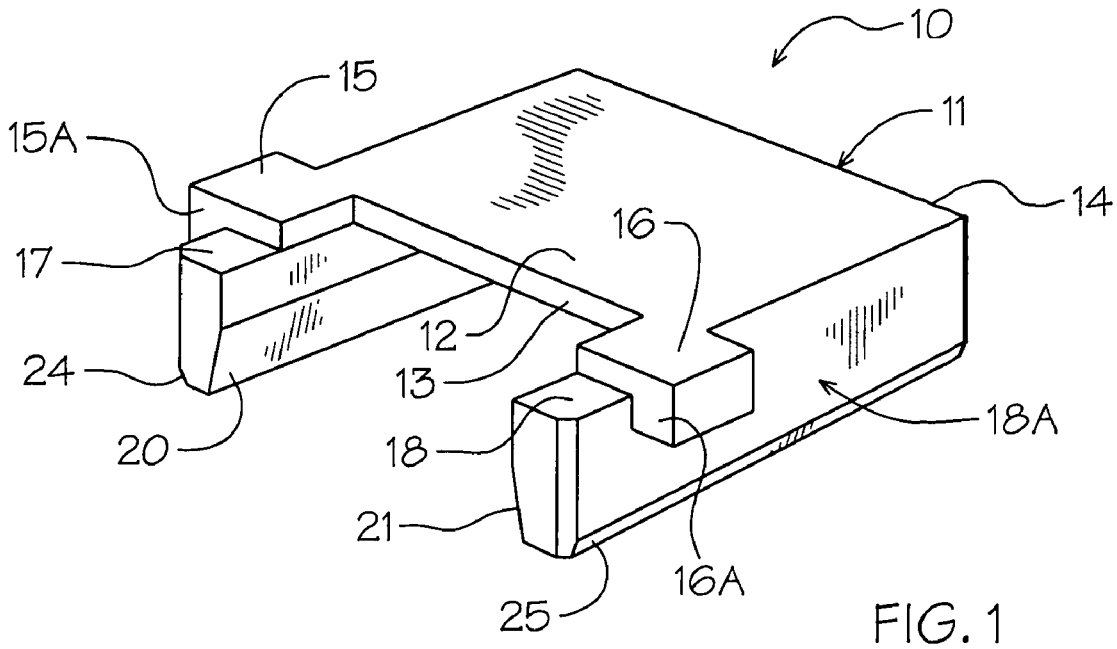
FIG. 1 is a perspective view of the door frame alignment device of the invention.
Figure 2:
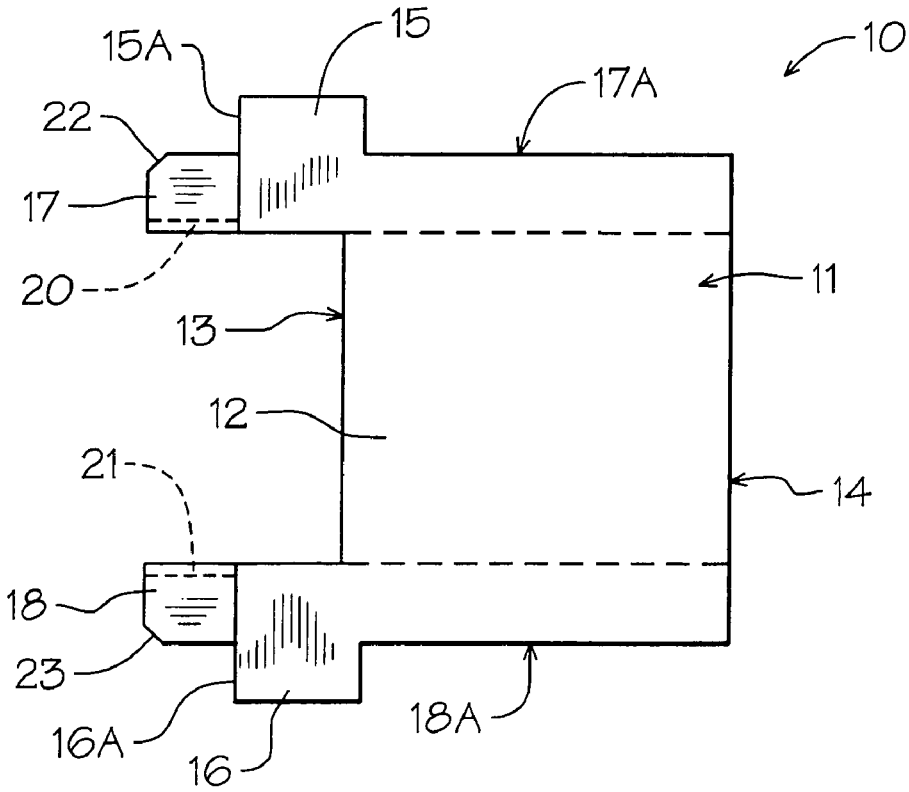
FIG. 2 is a top plan view thereof.
Figure 3:
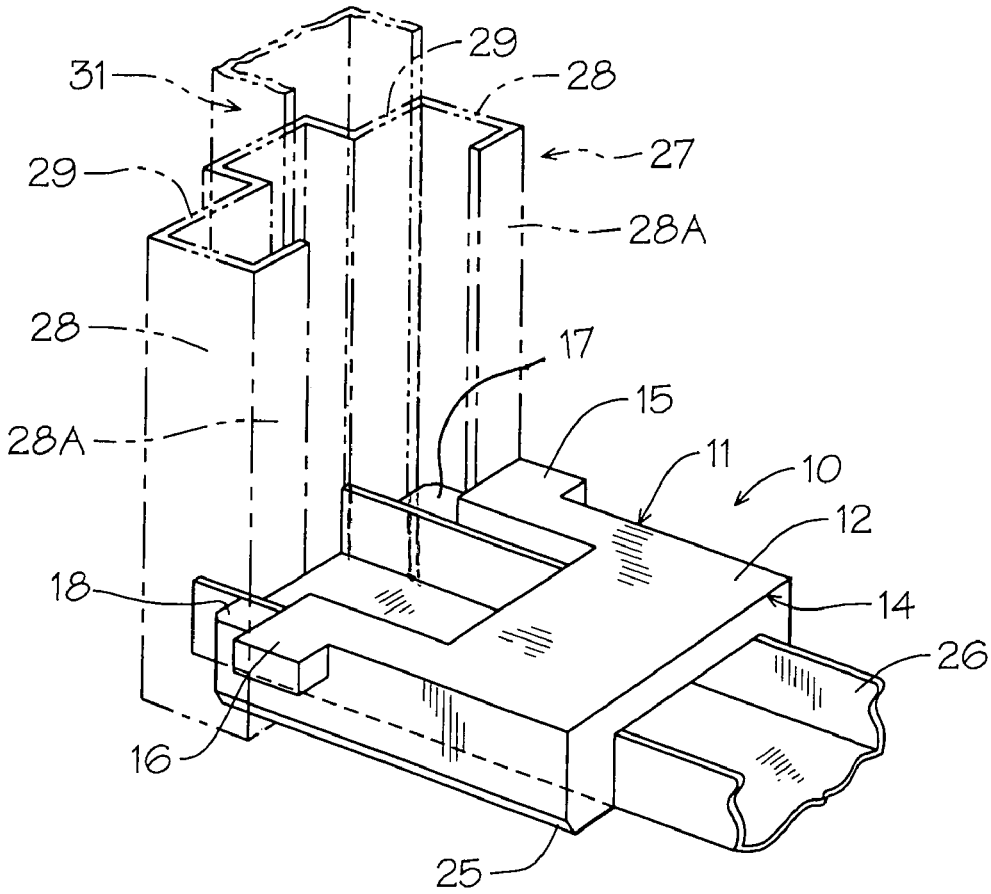
FIG. 3 is a perspective view of the invention in use.

Referring to FIGS. 1-3 of the drawings, a framing guide tool 10 of the invention can be seen having a main body member 11 which is preferably made of a composite or synthetic resin material. The main body member 11 has an interconnecting portion 12 of a generally rectangular shape with parallel spaced front and back edges 13 and 14 defining a dimensional thickness therebetween of a plate like configuration. A pair of oppositely disposed identical tab portions 15 and 16 extend from the front edge 13 overlying a pair of spaced parallel guide legs 17 and 18 extending integrally from the hereinbefore described main body member 11 as will be described in greater detail hereinafter.

Referring back to the guide tab portions 15 and 16, each has a vertically descending stop portion 15A and 16A that extends beyond respective side surfaces 17A and 18A of the guide legs 17 and 18. Each of the guide legs 17 and 18 extend beyond the hereinbefore described tab portions 15 and 16 and have effacing tapered inside surface portions 20 and 21 which extend longitudinally the length thereof as seen in dotted lines in FIG. 2 of the drawings. Additionally, outside vertical front edges 22 and 23 of the guide legs 17 and 18 and longitudinal extending lower outside edges 24 and 25 are tapered therealong so as to provide for ease of installation onto various bed frame configurations. It will be seen that the guide legs 17 and 18 are in spaced parallel orientation and are integrally extending from the hereinbefore described interconnecting portion 12 of the body member 11.

Figure 4:
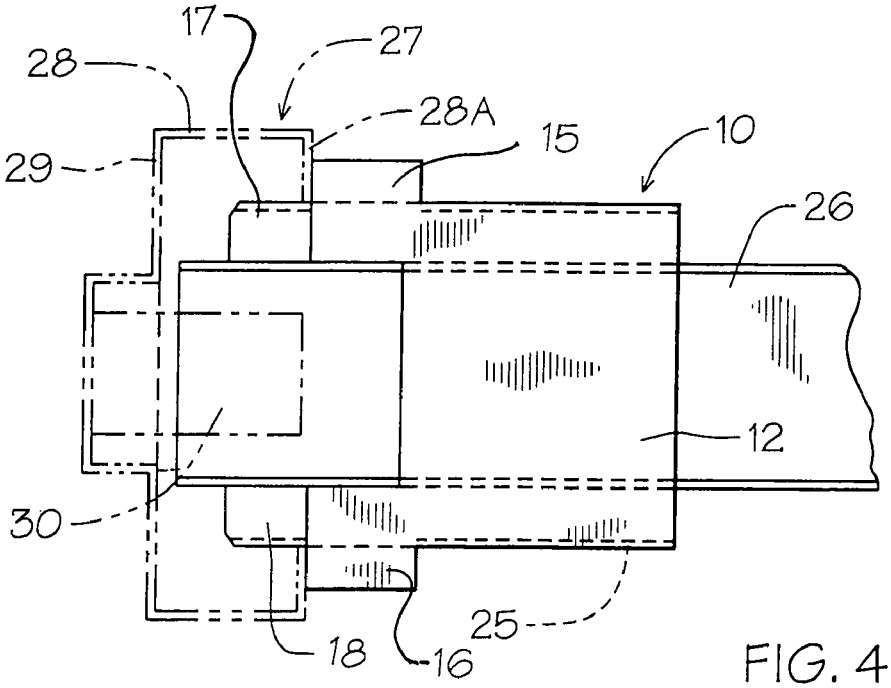
FIG. 4 is a top plan view on lines 5-5 of FIG. 4.
Figure 5:
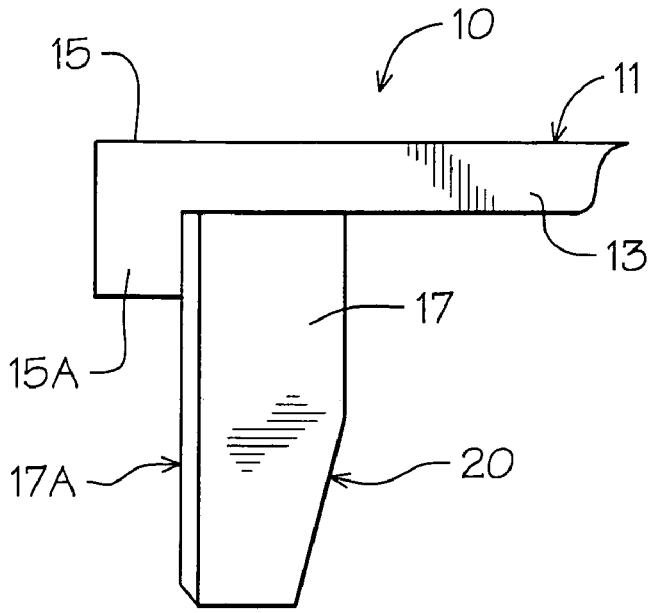
FIG. 5 is an enlarged partial front elevational view of a portion of the device.
Figure 6:
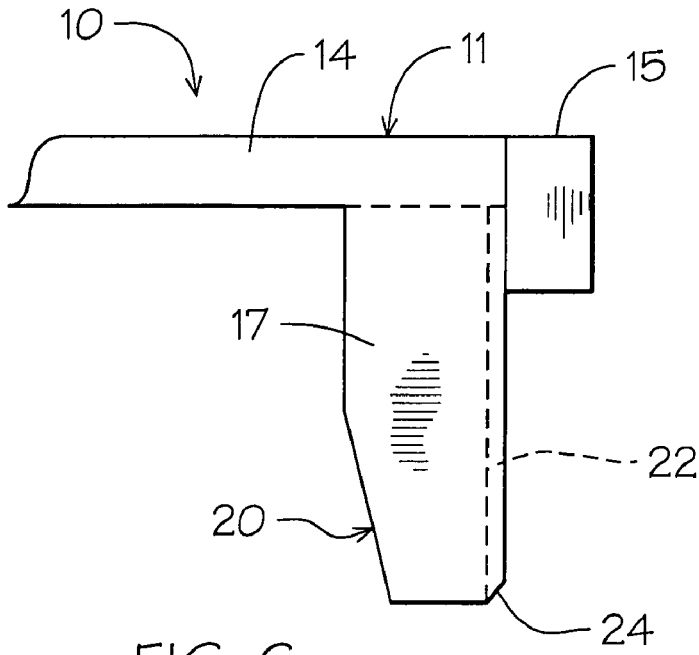
FIG. 6 is an enlarged partial rear elevational view thereof.

Referring now to FIGS. 3 and 4 of the drawings, the guide tool 10 of the invention can be seen in use wherein a base wall metal plate element 26 is illustrated with the tool 10 engaged thereon. A portion of a door frame 27 shown in broken lines being positioned in relation to the base wall plate 26 by the alignment tool 10. The door frame has sidewalls 28 with inturned elongated flanges 28A and rear walls 29. A horizontal engagement tab 30 extends inwardly from the bottom of the door frame between the respective sidewalls 28 with a vertical stud 31 is shown for illustration only. The guide tool 10 of the invention is slidably received over and onto the base plate element 26 with the legs 17 and 18 engaging the adjacent floor surface. The respective tab stop portions 15A and 16A provide for an indexing "stop" against the corresponding respective inturned flanges 28A of the door frame 27 while the guide legs 17 and 18 extending portions align the door frame 27 with the center line axis of the base frame element 26 best seen in FIG. 4 of the drawings.

It will be seen that the transverse dimensions of the legs 17 and 18 impart the proper hereinbefore described axial alignment while the "stop" tabs 15 and 16, adjusting longitudinally, align the frame to the base plate 26 of the (wall) spacing end wall stud 31 shown for clarity in dotted lines in FIG. 3 of the drawings.

Once the door frame is secured so aligned via the mounting tab 26 the tool 10 can be removed and positioned vertically to confirm final door frame alignment therewith.

It will thus be seen that a new and novel door frame alignment tool has been illustrated and described and it will be apparent to those skilled in the art that various changes and modifications may be made thereto without departing from the spirit of the invention.

Therefore I claim:

1. A door frame alignment tool comprising, a pair of spaced parallel guide legs interconnected by an overlying plate configuration portion, co-aligned tab extensions on said respective guide legs extending from said plate configuration, means for adjustably positioning said guide legs on a wall stud member comprises, tapered inner side surface portions on said legs extending longitudinally length thereof and have outside surface portions co-planar with said interconnection plate portion, said tab extension having a vertically descending stop portion on the outside leg surfaces for engagement on a door frame.

2. The door frame alignment tool set forth in claim 1 wherein said guide legs and said interconnecting plate and said co-aligned tabs are of an integral configuration.

3. The door frame alignment tool set forth in claim 1 wherein said respective tab extensions define, tab end surfaces extending vertically and horizontally from said guide legs.

4. The door frame alignment tool set forth in claim 1 wherein said guide legs have longitudinally extending tapered lower outer edges.

5. The door frame alignment tool set forth in claim 1 wherein said guide legs have tapered outer front vertical edges in spaced relation to said co-aligned tab extensions.

* * * * *